US005823371A

United States Patent [19]

Riley et al.

[11] Patent Number: 5,823,371

[45] Date of Patent: Oct. 20, 1998

[54] MAGNETICALLY ACTUATED COUPLER ASSEMBLY

[75] Inventors: H. Lee Riley, Middletown, Del.; Robert H. Staat, Goshen, Ky.

[73] Assignee: Bachmann Industries, Inc., Philadelphia, Pa.

[21] Appl. No.: 941,925

[22] Filed: Oct. 1, 1997

[51] Int. Cl.[6] ..... B61G 3/00

[52] U.S. Cl. ..... 213/75 TC; 213/75 D

[58] Field of Search ..... 213/75 R, 75 TC, 213/75 D, 100 R, 104, 109

[56] References Cited

U.S. PATENT DOCUMENTS

| | | | |
|---|---|---|---|
| D. 326,693 | 6/1992 | Gramera . | |
| D. 367,684 | 3/1996 | Wilson . | |
| 3,111,229 | 11/1963 | Edwards et al. . | |
| 3,469,713 | 9/1969 | Edwards et al. . | |
| 3,564,766 | 2/1971 | Edwards et al. . | |
| 4,650,081 | 3/1987 | Diller . | |
| 5,316,158 | 5/1994 | Dunham et al. | 213/75 TC |
| 5,509,546 | 4/1996 | Staat . | |
| 5,662,229 | 9/1997 | Edwards | 213/75 TC |

OTHER PUBLICATIONS

Product Insert for Kadee Quality Products Magne–Matic Coupler, MKD 5&10 Couplers, admitted prior art. (No Date).

*Primary Examiner*—Mark Tuan Le
*Attorney, Agent, or Firm*—Panitch Schwarze Jacobs & Nadel, P.C

[57] ABSTRACT

A magnetically actuated coupler assembly for model railroad rolling stock is provided. The coupler assembly includes a drawbar having first and second ends. The first end includes an aperture defined therethrough adapted for mounting in a coupler pocket on model railroad rolling stock. The second end includes a coupler head. A coupler knuckle is pivotably mounted to the coupler head by a magnetically actuated pivot post. A first coil spring alignment pin is located on the second end of the drawbar. A second coil spring alignment pin is located on the coupler knuckle. A coil spring is mounted between the coupler head and the coupler knuckle on the first and second coil spring alignment pins for resiliently urging the coupler knuckle to a coupled position. At least one of the first and second coil spring alignment pins includes a coil spring retainer which engages at least a portion of the coil spring to prevent the coil spring from becoming dislodged from the at least one of the first and second coil spring alignment pins.

15 Claims, 2 Drawing Sheets

MAGNETICALLY ACTUATED COUPLER ASSEMBLY

BACKGROUND OF THE INVENTION

The present invention relates to magnetically actuated coupler assemblies for model railroad rolling stock, and more particularly, to model railroad couplers which automatically couple and uncouple in response to a magnetic field.

Magnetically actuated couplers for model railroading are generally known. Such couplers are typically used with HO gauge model trains, but can be used on larger or smaller model trains, in order to allow a model railroader to remotely couple and uncouple rolling stock. A common goal of most magnetically actuated couplers is to attempt to provide an authentic looking coupler while still having the required functionality for coupling and uncoupling.

Early magnetic uncoupling systems are shown in U.S. Pat. Nos. 3,111,229 and 3,115,255. Further refinements which were developed in order to overcome certain inadequacies in these early couplers are disclosed in U.S. Pat. Nos. 3,117,676 and 3,469,713. In each of these systems, a magnetically actuated pin extends downwardly from the hook of the coupler. The pin is acted upon by a stationary magnet located between the tracks which causes the hook of the couplers to open and release one model railroad car from engagement with a second car when tension on the mating couplers is released.

In a well known, commercially available mechanical coupler, the coupler includes a drawbar which is pivotably mounted in a coupler pocket. A separate centering spring is provided to bias the drawbar to a centered position. A coupler head is located on the opposite end of the drawbar. A coupler knuckle is pivotably mounted to the coupler head by a magnetically actuated pin, and stops are provided on the coupler head which limit the travel of the coupler knuckle. The coupler knuckle is resiliently biased to a closed position by a coil spring which is mounted on alignment pins affixed to the coupler head and coupler knuckle. While this type of coupler has gained general acceptance among scale model railroaders, the problem with this known system is that the springs, which are extremely small in order to provide a more authentic looking coupler, often become fatigued and are dislodged from the locator pins and lost. A new spring must then be installed using tweezers or another fine hand tool by compressing and placing the replacement pin on the alignment pins.

It would be desirable to provide a model railroad coupler which maintains the same general scale appearance, but reduces or eliminates the possibility of the coupler knuckle biasing coil spring from becoming dislodged from the coupler assembly in order to reduce the need for replacing coupler springs and the corresponding down time required for "repairing" couplers.

BRIEF SUMMARY OF THE INVENTION

Briefly stated, the present invention provides a magnetically actuated coupler assembly for model railroad rolling stock. The coupler assembly includes a drawbar having first and second ends. The first end includes an aperture defined therethrough adapted for mounting in a coupler pocket on model railroad rolling stock. The second end includes a coupler head. A coupler knuckle is pivotably mounted to the coupler head by a magnetically actuated pivot post. A first coil spring alignment pin is located on the second end of the drawbar. A second coil spring alignment pin is located on the coupler knuckle. A coil spring is mounted between the coupler head and the coupler knuckle on the first and second coil spring alignment pins for resiliently urging the coupler knuckle to a coupled position. At least one of the first and second coil spring alignment pins includes a coil spring retainer which engages at least a portion of the coil spring to prevent the coil spring from becoming dislodged from the at least one of the first and second coil spring alignment pins.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
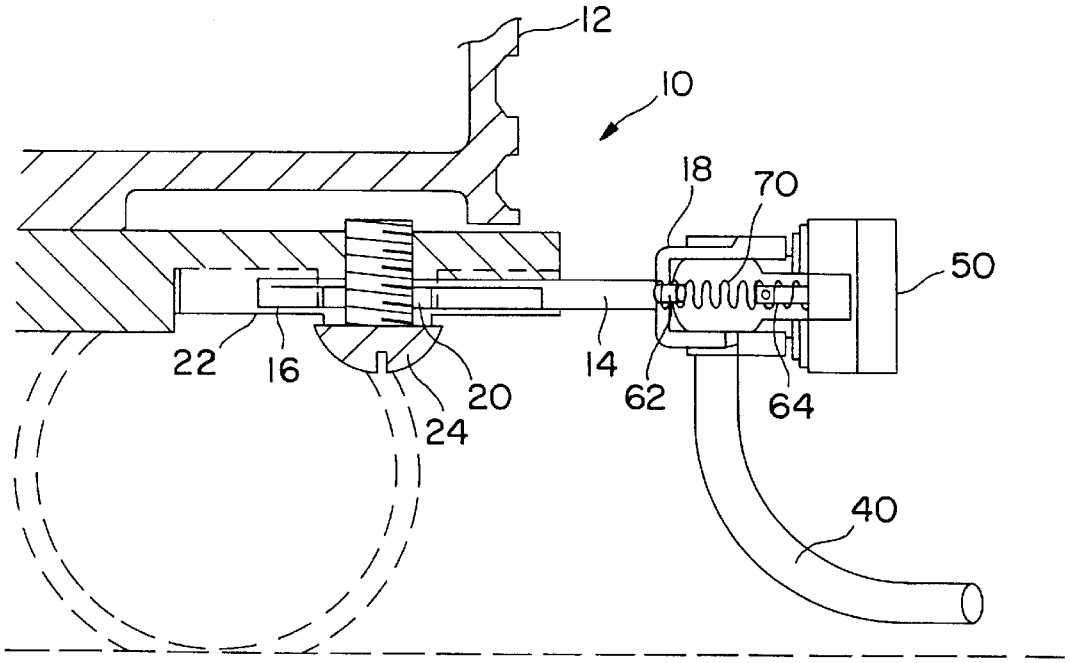
FIG. 1 is a partial elevational view of a portion of a piece of model railroad rolling stock including a magnetically actuated coupler assembly in accordance with the present invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the magnetically actuated coupler assembly 10 and designated parts thereof. The terminology includes the words above specifically mentioned, derivatives thereof and words of similar import.

Referring to the drawings, wherein like numerals indicate like elements throughout, there is shown in FIGS. 1–9, a magnetically actuated coupler assembly 10 for use with model railroad rolling stock 12. Those of ordinary skill in the art will recognize that the model railroad rolling stock 12 may be locomotives, flat cars, box cars, or any other types of model railroad car. Additionally, the model railroad rolling stock may be of any desired gauge or scale, such as HO or N, and the invention is not limited to a particular size.

The magnetically actuated coupler assembly 10 includes a drawbar 14 having a first and second ends 16, 18. The first end includes an aperture 20 defined therethrough which is adapted for mounting in a coupler pocket 22 on the model railroad rolling stock 12, as shown in FIG. 1. The drawbar 14 may be held in position by a screw 24, or may be placed over a pivot post located in the coupler pocket 22, and a cover (not shown) is then placed over the coupler pocket 22 to maintain the drawbar 14 connected to the pivot post. Those skilled in the art will recognize from the present disclosure that the precise arrangement of the pivotable connection of the drawbar 14 to the model railroad rolling stock 12 can be varied, as desired, in order to provide a pivotable connection, and the precise type of connection is not critical to the present invention.

Figure 2:
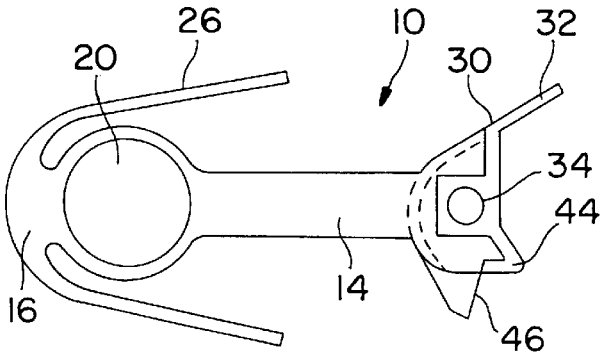
FIG. 2 is a top plan view of the drawbar of the magnetically actuated coupler assembly shown in FIG. 1.
Figure 4:
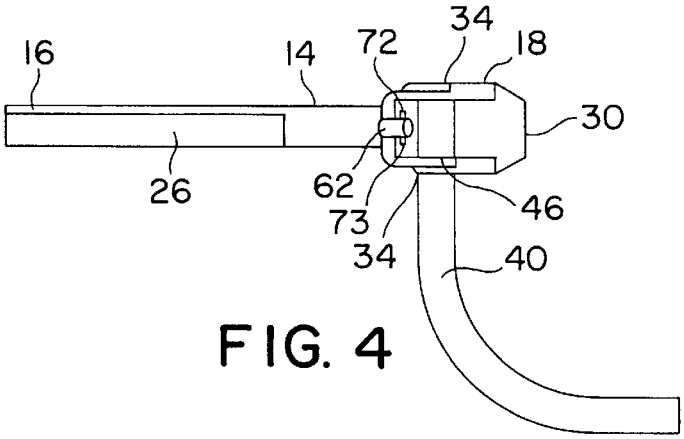
FIG. 4 is an elevational view of the drawbar shown in FIG. 2.

As shown in detail in FIGS. 2 and 4, preferably an integral leaf centering spring 26 is connected to the first end 16 of the drawbar 14. The integral leaf centering spring 26 is positioned within the coupler pocket 22 to resiliently bias the drawbar 14 to a centered position with respect to the track upon which the model railroad rolling stock 12 travels. It will be recognized by those skilled in the art from the present disclosure that the integral leaf centering spring 26 may be omitted, and a separate centering spring of the type generally known to those of ordinary skill in the art may be used in order to bias the drawbar 14 to the centered position. Such separate centering springs are generally well known in the art and are used in conjunction with drawbars having a modified configuration for the first end 16 which is complementary to the separate spring arrangement.

As shown in FIGS. 1–4, the second end 18 of the drawbar 14 includes a coupler head 30 having an extension lip 32 extending from one side thereof. Apertures 34 are defined through the coupler head 30. The apertures 34 have a common axis, aligned generally parallel to the axis of the aperture 20 through the first end 16 of the drawbar 14.

Figure 3:
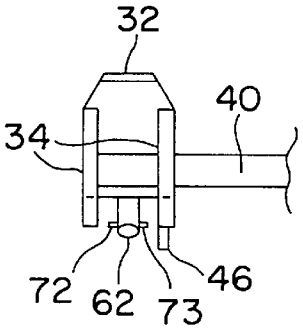
FIG. 3 is a right side view of the drawbar shown in FIG. 2.

As shown in FIGS. 3 and 4, a magnetically actuated pivot post 40 is pivotably installed through the apertures 34 in the coupler head 30. The magnetically actuated pivot post 40 is generally L-shaped, and is of the type know to those of ordinary skill in the art. Although the magnetically actuated pivot post 40 is shown without the coupler knuckle 50 in FIGS. 2–4, those of ordinary skill in the art will recognize that the pivot post 40 is not assembled to the drawbar 14 without the coupler knuckle being in position, and the coupler knuckle 50 has been omitted from FIGS. 2–4 in order to more clearly illustrate the drawbar 14.

Figure 5:
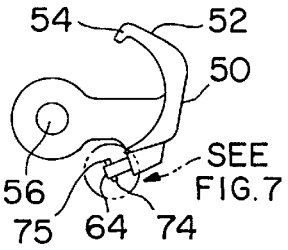
FIG. 5 is a top plan of a coupler knuckle used in the magnetically actuated coupler assembly shown in FIG. 1.
Figure 6:
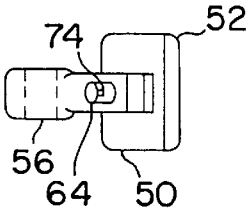
FIG. 6 is an elevational view of the coupler knuckle shown in FIG. 5.
Figure 7:
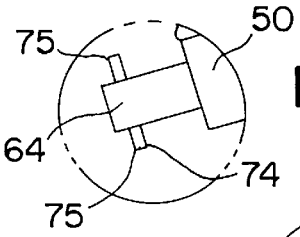
FIG. 7 is a greatly enlarged view of a portion of FIG. 5.

The coupler knuckle 50 of the present invention is shown in detail in FIGS. 5 and 6. The coupler knuckle 50 includes a hook-shaped end 52 with a lip 54 to resist decoupling of model railroad rolling stock and locomotives under the tension of movement. The coupler knuckle 50 also includes an aperture 56 defined therethrough, through which the magnetically actuated pivot post 40 is installed when the coupler knuckle 50 is assembled with the coupler head 30 on the second end 18 of the drawbar 14.

Figure 8:
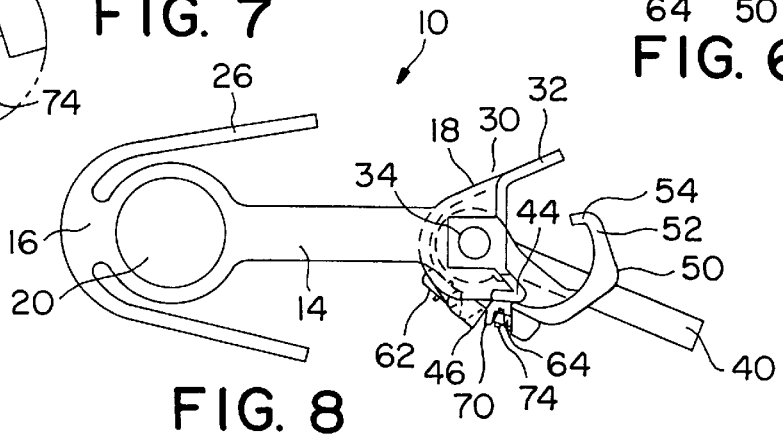
FIG. 8 is a top plan view of the magnetically actuated coupler assembly.
Figure 9:
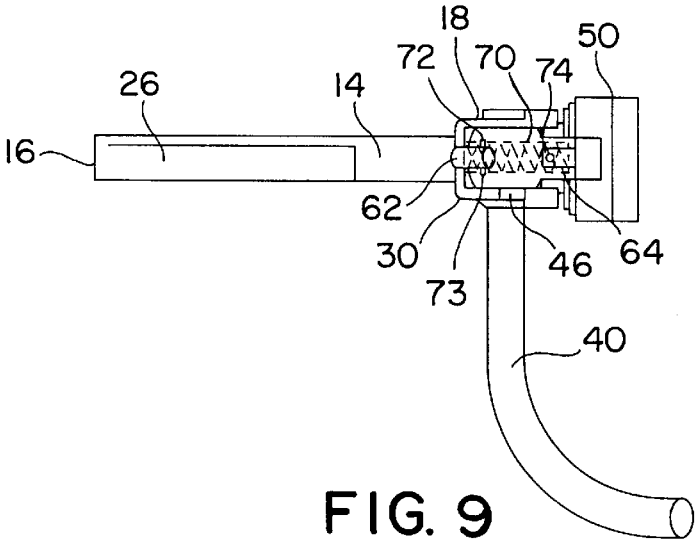
FIG. 9 is an elevational view of the magnetically actuated coupler assembly shown in FIG. 8.

As shown in detail in FIGS. 8 and 9, the coupler knuckle 50 is pivotably mounted to the coupler head 30 by the magnetically actuated pivot post 40 in a manner generally known to those of ordinary skill in the art, with the coupler knuckle 50 engaging a portion of the magnetically actuated pivot post 40 such that as the magnetically actuated pivot post 40 rotates in the apertures 34 through the coupler head 30, the coupler knuckle 50 also rotates.

As shown most clearly in FIG. 3, a first coil spring alignment pin 62 is located on the second end 18 of the drawbar 14. A second coil spring alignment pin 64 is located on the coupler knuckle 50, as shown most clearly in FIGS. 5 and 6, and is oriented to generally face the first coil spring alignment pin 62. Preferably, the first and second coil spring alignment pins 62, 64 are generally cylindrical in configuration and are molded integrally with the drawbar 14 and the coupler knuckle 50, respectively. However, it will be understood by those of ordinary skill in the art from the present disclosure that the coil spring alignment pins 62, 64 may be formed separately and can be attached to the drawbar 14 and the coupler knuckle 50 in a separate operation, utilizing heat fusing, a mechanical interlocking fit or adhesive, if desired. It will be similarly recognized that the coil spring alignment pins 62, 64 may have other shapes, such as cones, parallelepipeds, or other multi-sided cross-sectional configurations which have been extended to form a protrusion upon which the end of the coil spring 70 can be installed, or any desired combination thereof.

As shown most clearly in FIGS. 1, 8 and 9, a coil spring 70 is mounted between the coupler head 30 and the coupler knuckle 50 on the first and second coil spring alignment pins 62, 64 for resiliently urging the coupler knuckle 50 to a coupled position relative to the drawbar 14. The coupled position is illustrated most clearly in FIG. 7 where the coil spring 70 has urged the coupler knuckle to a position where it contacts a travel limit stop 44 on the coupler head 30. When a magnetic force acts upon the magnetically actuated pivot post 40, the pivot post 40 and coupler knuckle 50 rotate until the coupler 50 contacts a second limit stop 46, shown most clearly in FIGS. 2 and 8.

In order to prevent the coil spring 70 from becoming dislodged or lost, at least one of the first and second coil spring alignment pins 62, 64 includes a coil spring retainer 72 (shown in FIGS. 3, 4, and 9) or 74 (shown in FIGS. 5–9), which engages at least a portion of the coil spring 70 to prevent the coil spring 70 from becoming dislodged from the at least one of the first and second coil spring alignment pins 62, 64. The first and second alignment pins 62, 64 each include a longitudinal axis, and the coil spring retainer 72, 74 located on at least one of the first and second alignment pins extends generally perpendicularly from the respective longitudinal axis of the respective alignment pin 62, 64. This is shown most clearly with respect to the coil spring retainer 74 in FIG. 7.

Preferably, the coil spring retainer 72, 74 comprises a generally radially extending prong 73, 75 located on one of the alignment pins 62, 64 which engages at least a portion of the coil spring 70. However, it will be recognized by those skilled in the art from the present disclosure that any desired number of prongs 73, 75 may be provided on either the first or second coil spring alignment pin 62, 64 or both alignment pins 62, 64. In the preferred embodiment, two generally opposing radially extending prongs 73, 75 are located on opposite sides of each of the alignment pin 62, 64. Again, this is shown most clearly in FIG. 7 with respect to the coil spring retainer 74 on the second alignment pin 64. The coil spring retainer 72 on the first alignment pin 62 is arranged in a similar manner, but is oriented generally vertically with respect to the drawbar 14, as opposed to the horizontal arrangement of the coil spring retainer 74 on the second alignment pin 64. However, the specific orientation of the coil spring retainers 72, 74 can be varied to any desired orientation.

Preferably, each coil spring retainer 72, 74 comprises a resilient member which is deflectable to allow installation of the coil spring 70 onto the first and/or second alignment pins 62, 64 by resiliently deflecting as the coil spring 70 is installed. In the preferred embodiment, the prongs 73, 75 are resiliently deflectable to allow installation of the coil spring 70 with a portion of the prongs 73, 75 extending between the coils of the coil spring 70 at one or both ends.

It will be recognized by those of ordinary skill in the art from the present disclosure that the form of the coil spring retainers 72, 74 may be varied, if desired. For example, the coil spring retainers 72, 74 may comprise a partial or complete thread, an annular protrusion or a lip, as long as it extends outwardly enough from the alignment pin 62, 64 to engage at least a portion of the coil spring 70. Any other suitable structure may be provided within the scope of the present invention which engages the coil spring 70 to prevent the coil spring 70 from becoming easily dislodged once it is installed on one or both coil spring alignment pins 62, 64.

It will be similarly recognized by those skilled in the art from the present disclosure that the prongs 73, 75 need not be resiliently deflectable and the coil spring can be screwed or threaded over the prongs 73, 75 in order to install the coil spring 70 on the first and second coil spring alignment pins 62, 64, if desired.

In a preferred embodiment, the drawbar 14 is formed integrally with the first coil spring alignment pin 62 and the coil spring retainer 72, in the form of prongs 73. Similarly, the coupler knuckle 50 is formed integrally with the second coil spring alignment pin 64 and the coil spring retainer 74, in the form of prongs 75. Preferably, the drawbar 14 and the coupler knuckle 50 are molded from a polymeric material, such as CELCON™, which is available from Hoechst-Celanese Corporation. However, it will be recognized by those skilled in the art from the present disclosure that any other suitable material having the required strength may be used, such as an engineering polymer, resin or die cast metal alloy.

The present invention solves a long known problem with existing magnetically actuated couplers for HO gauge model railroaders which utilize a coil spring 70. In such known couplers, the coil springs often become dislodged and lost. Due to the size of the coil springs 70, which are generally on the order of 0.15 inches long with a coil diameter of 0.040 inches for HO gauge, it becomes extremely tedious and time consuming to replace the coil springs 70 as they become dislodged and lost.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A magnetically actuated coupler assembly for model railroad rolling stock comprising:

a drawbar having first and second ends, the first end including an aperture defined therethrough adapted for mounting in a coupler pocket on the model railroad rolling stock, and the second end including a coupler head;

a coupler knuckle pivotably mounted to the coupler head by a magnetically actuated pivot post;

a first coil spring alignment pin located on the second end of the drawbar;

a second coil spring alignment pin located on the coupler knuckle;

a coil spring mounted between the coupler head and the coupler knuckle on the first and second coil spring alignment pins for resiliently urging the coupler knuckle to a coupled position; and at least one of the first and second coil spring alignment pins including a coil spring retainer mounted thereon which engages at least a portion of the coil spring to prevent the coil spring from becoming dislodged from the at least one of the first and second coil spring alignment pins.

2. The magnetically actuated coupler assembly of claim 1 wherein the coil spring retainer is a resilient member which is deflectable to allow installation of the coil spring onto the at least one of the first and second alignment pins.

3. The magnetically actuated coupler assembly of claim 1 wherein the first and second alignment pins each include a longitudinal axis, and the coil spring retainer on the at least one of the first and second alignment pins extends generally perpendicularly from the longitudinal axis of the at least one of the first and second alignment pins.

4. The magnetically actuated coupler assembly of claim 1 wherein the coil spring retainer is located on the first coil spring alignment pin and is formed integrally with the drawbar.

5. The magnetically actuated coupler assembly of claim 4 wherein the coil spring retainer comprises a generally radially extending prong located on the first alignment pin which engages a portion of the coil spring.

6. The magnetically actuated coupler assembly of claim 5 wherein the prong is resiliently deflectable.

7. The magnetically actuated coupler assembly of claim 4 wherein the coil spring retainer comprises two generally opposing radially extending prongs located on opposite sides of the first alignment pin.

8. The magnetically actuated coupler assembly of claim 1 wherein the coil spring retainer is located on the second coil spring retainer pin.

9. The magnetically actuated coupler assembly of claim 8 wherein the coil spring retainer comprises a generally radially extending prong located on the second alignment pin which engages a portion of the coil spring.

10. The magnetically actuated coupler assembly of claim 9 wherein the prong is resiliently deflectable.

11. The magnetically actuated coupler assembly of claim 8 wherein the coil spring retainer comprises two generally opposing radially extending prongs located on opposite sides of the second alignment pin.

12. The magnetically actuated coupler assembly of claim 1 wherein each of the first and second alignment pins includes a coil spring retainer.

13. The magnetically actuated coupler assembly of claim 12 wherein each of the coil spring retainers comprises a generally radially extending prong.

14. The magnetically actuated coupler assembly of claim 12 wherein each of the coil spring retainers comprises two generally opposing radially extending prongs located on opposite sides of each of the first and second alignment pins.

15. The magnetically actuated coupler assembly of claim 14 wherein each of the prongs is resiliently deflectable.

* * * * *